US012601520B2

(12) United States Patent
Pike

(10) Patent No.: US 12,601,520 B2
(45) Date of Patent: Apr. 14, 2026

(54) GAS VENTILATION ENCLOSURE, SYSTEM, AND METHOD

(71) Applicant: Michael Thomas Pike, Des Moines, IA (US)

(72) Inventor: Michael Thomas Pike, Des Moines, IA (US)

( * ) Notice: Subject to any disclaimer, the term of this patent is extended or adjusted under 35 U.S.C. 154(b) by 389 days.

(21) Appl. No.: 18/345,277

(22) Filed: Jun. 30, 2023

(65) Prior Publication Data

US 2024/0003587 A1 Jan. 4, 2024

Related U.S. Application Data

(60) Provisional application No. 63/367,606, filed on Jul. 2, 2022.

(51) Int. Cl.

| | |
|---|---|
| ***F24F 13/02*** | (2006.01) |
| ***F24F 7/00*** | (2021.01) |
| ***F24F 7/02*** | (2006.01) |

(52) U.S. Cl.

CPC ..... *F24F 13/0227* (2013.01); *F24F 7/02* (2013.01); *F24F 2007/0025* (2021.01)

(58) Field of Classification Search

CPC ..... F24F 13/0227; F24F 13/068; F24F 7/10
See application file for complete search history.

(56) References Cited

U.S. PATENT DOCUMENTS

| | | | |
|---|---|---|---|
| 1,554,180 | A | 9/1925 | Trader |
| 6,319,115 | B1 | 11/2001 | Shingaki |
| 9,227,730 | B2 | 1/2016 | Markwart et al. |
| 2012/0115409 | A1 | 5/2012 | Kelpentidjian |

FOREIGN PATENT DOCUMENTS

DE 202009012529 U1 2/2011

*Primary Examiner* — Allen R. B. Schult
(74) *Attorney, Agent, or Firm* — Bryan J. Massey; Alandra Adams

(57) ABSTRACT

Examples of the present disclosure include an enclosure. The enclosure includes a floor. The floor includes a first surface, a second surface opposite the first surface, and floor apertures. The enclosure includes a ceiling having ceiling apertures. The enclosure includes interior walls extending, along a length of the interior walls, from the ceiling to at least the floor. The enclosure includes an exterior wall. The exterior wall includes a first portion extending from at least the ceiling of the enclosure to at least the first surface, a second portion extending below the first surface at least one exterior wall aperture. The at least one exterior wall aperture extends through a thickness of the exterior wall and is located no more than a distance, from at least one of the first surface and the second surface of the floor, equal to twenty percent of a total length of the exterior wall.

20 Claims, 10 Drawing Sheets

GAS VENTILATION ENCLOSURE, SYSTEM, AND METHOD

CROSS-REFERENCE TO RELATED APPLICATION

This application claims the benefit of U.S. Provisional Patent Application No. 63/367,606, filed Jul. 2, 2022, which is incorporated herein by reference.

FIELD

This disclosure relates generally to gas ventilation and more particularly to a gas ventilation enclosure, system, and method.

BACKGROUND

Ventilation systems remove gases from an environment. Such gases can include stale, contaminated, or odorous air. For example, ventilation systems remove unwanted gases from indoor residential environments, bathrooms, kitchens, hospitals, or laboratories.

SUMMARY

The subject matter of the present application has been developed in response to the present state of the art, and in particular, in response to the shortcomings of gas ventilation, that have not yet been fully solved by currently available techniques. Accordingly, the subject matter of the present application has been developed to provide methods, systems, and apparatuses for gas ventilation that overcome at least some of the above-discussed shortcomings of prior art techniques.

The following is a non-exhaustive list of examples, which may or may not be claimed, of the subject matter, disclosed herein.

The following portion of this paragraph delineates example 1 of the subject matter, disclosed herein. According to example 1, an enclosure includes a floor. The floor includes a first surface, a second surface opposite the first surface and floor apertures. Each one of the floor apertures extends through a thickness of the floor from the first surface to the second surface. The enclosure includes a ceiling having ceiling apertures. The enclosure includes interior walls extending, along a length of the interior walls, from the ceiling to at least the floor. The enclosure includes an exterior wall. The exterior wall includes a first portion extending from at least the ceiling of the enclosure to at least the first surface, a second portion extending below the first surface at least one exterior wall aperture. The at least one exterior wall aperture extends through a thickness of the exterior wall and is located no more than a distance, from at least one of the first surface and the second surface of the floor, equal to twenty percent of a total length of the exterior wall.

The following portion of this paragraph delineates example 2 of the subject matter, disclosed herein. According to example 2, which encompasses example 1, above, one or more exterior wall apertures of the at least one exterior wall aperture is positioned on the second portion.

The following portion of this paragraph delineates example 3 of the subject matter, disclosed herein. According to example 3, which encompasses example 1 or 2, above, the enclosure includes a base on which the floor is positioned. The base includes a number of channels. Each channel of the number of channels connects an exterior wall aperture of the at least one exterior wall aperture and at least one floor aperture of the floor apertures.

The following portion of this paragraph delineates example 4 of the subject matter, disclosed herein. According to example 4, which encompasses any one of examples 1-3, above, the second portion includes a surface of the base.

The following portion of this paragraph delineates example 5 of the subject matter, disclosed herein. According to example 5, which encompasses any one of examples 1-4, above, the at least one exterior wall aperture is configured to allow gas to pass from an exterior of the enclosure into at least one of an interior of the enclosure and a channel of the number of channels.

The following portion of this paragraph delineates example 6 of the subject matter, disclosed herein. According to example 6, which encompasses any one of examples 1-5, above, the enclosure includes a passage between the ceiling and a top side of the enclosure.

The following portion of this paragraph delineates example 7 of the subject matter, disclosed herein. According to example 7, which encompasses any one of examples 1-6, above, each ceiling aperture of the ceiling apertures are configured to allow gas pulled by a gas flow element connected to the passage to travel from an interior of the enclosure, through at least one ceiling aperture of the ceiling apertures, and through the passage.

The following portion of this paragraph delineates example 8 of the subject matter, disclosed herein. According to example 8, which encompasses any one of examples 1-7, above, the length of the exterior wall is not less than four feet and not greater than twenty feet.

The following portion of this paragraph delineates example 9 of the subject matter, disclosed herein. According to example 9, which encompasses any one of examples 1-8, above, an area of the at least one exterior wall aperture is not less than 0.01 square inches and not greater than 0.1 square inches.

The following portion of this paragraph delineates example 10 of the subject matter, disclosed herein. According to example 10, which encompasses any one of examples 1-9, above, each of the floor apertures includes at least one point that is coplanar, in a plane substantially perpendicular to the floor, with a point of at least one ceiling aperture of the ceiling apertures.

The following portion of this paragraph delineates example 11 of the subject matter, disclosed herein. According to example 11, a gas ventilation system includes an enclosure configured to be positioned within an indoor or outdoor environment. The enclosure includes a floor. The floor includes a first surface, a second surface opposite the first surface, and floor apertures. One of the four operators extends through a thickness of the floor from the first surface to the second surface. The enclosure includes a ceiling having ceiling apertures. The enclosure includes interior walls extending, along a length of the interior walls, from the ceiling to at least the floor. Enclosure includes an into an exterior wall. The exterior wall includes a first portion extending from at least the ceiling of the enclosure to at least the first surface. The exterior wall includes a second portion extending below the first surface. The exterior wall includes at least one exterior wall aperture extending through a thickness of the exterior wall. The at least one exterior wall aperture is located no more than a distance, from at least one of the first surface and the second surface of the floor, equal to twenty percent of a total length of the exterior wall. The enclosure includes a passage connected to the ceiling apertures. The system includes a duct connected to the passage. The system includes a gas flow element configured to pull gas from an interior of the enclosure, through the number of ceiling apertures, through the passage, and into the duct.

The following portion of this paragraph delineates example 12 of the subject matter, disclosed herein. According to example 12, which encompasses example 11, one or more exterior wall apertures of the at least one exterior wall aperture is positioned on the second portion.

The following portion of this paragraph delineates example 13 of the subject matter, disclosed herein. According to example 13, which encompasses any of examples 11-12, a gas ventilation system includes a base on which the floor is positioned. The base includes a number of channels. Each channel of the number of channels connects an exterior wall aperture of the at least one exterior wall aperture and at least one floor aperture of the floor apertures.

The following portion of this paragraph delineates example 14 of the subject matter, disclosed herein. According to example 14, which encompasses any of examples 11-13, the portion is a surface of the base.

The following portion of this paragraph delineates example 15 of the subject matter, disclosed herein. According to example 15, which encompasses any of examples 11-14, at least one exterior wall aperture is configured to allow gas to pass from an exterior of the enclosure to at least one of an interior of the enclosure and a channel of the number of channels.

The following portion of this paragraph delineates example 16 of the subject matter, disclosed herein. According to example 16, which encompasses any of examples 11-15, the duct is connected to a vent of at least one of a wall of a structure defining the indoor environment and a ceiling of a structure defining the indoor environment.

The following portion of this paragraph delineates example 17 of the subject matter, disclosed herein. According to example 17, which encompasses any of examples 11-16, the total length of the exterior wall is not less than four feet and not greater than twenty feet.

The following portion of this paragraph delineates example 18 of the subject matter, disclosed herein. According to example 18, which encompasses any of examples 11-17, an area of the at least one exterior wall aperture is not less than 0.01 square inches and not greater than 0.1 square inches.

The following portion of this paragraph delineates example 19 of the subject matter, disclosed herein. According to example 19, which encompasses any of examples 11-18, each of the floor apertures includes at least one point that is coplanar, in a plane substantially perpendicular to the floor, with at least one point of at least one ceiling aperture of the ceiling apertures.

The following portion of this paragraph delineates example 20 of the subject matter, disclosed herein. According to example 20, a method of manufacturing a gas ventilation system includes forming an enclosure by removably positioning a floor and a base joined to the floor. The floor includes floor apertures. The method includes joining the floor to interior walls extending, along a length of the interior walls, from a ceiling to at least the floor. Joining the floor to the interior walls forms an exterior wall. The exterior wall includes a first portion, a second portion extending below the first surface, and at least one exterior wall aperture extending through a thickness of the exterior wall. The exterior wall aperture is located no more than a distance, from at least one of a first surface and a second surface of the floor, equal to twenty percent of a total length of the exterior wall. The method includes joining a ceiling to at least one of the interior walls and the exterior wall. The ceiling includes ceiling apertures. The method includes forming a passage connected to the ceiling apertures. The method includes connecting a duct to the passage. The method includes positioning a gas flow element exterior to the enclosure. The gas flow element is configured to pull gas from an interior of the enclosure, through the ceiling apertures, through the passage, and into the duct.

The described features, structures, advantages, and/or characteristics of the subject matter of the present disclosure may be combined in any suitable manner in one or more examples and/or implementations. In the following description, numerous specific details are provided to impart a thorough understanding of examples of the subject matter of the present disclosure. One skilled in the relevant art will recognize that the subject matter of the present disclosure may be practiced without one or more of the specific features, details, components, materials, and/or methods of a particular example or implementation. In other instances, additional features and advantages may be recognized in certain examples and/or implementations that may not be present in all examples or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific examples that are illustrated in the appended drawings. Understanding that these drawings, which are not necessarily drawn to scale, depict only certain examples of the subject matter and are not therefore to be considered to be limiting of its scope, the subject matter will be described and explained with additional specificity and detail through the use of the drawings, in which.

DETAILED DESCRIPTION

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

Figure 1:
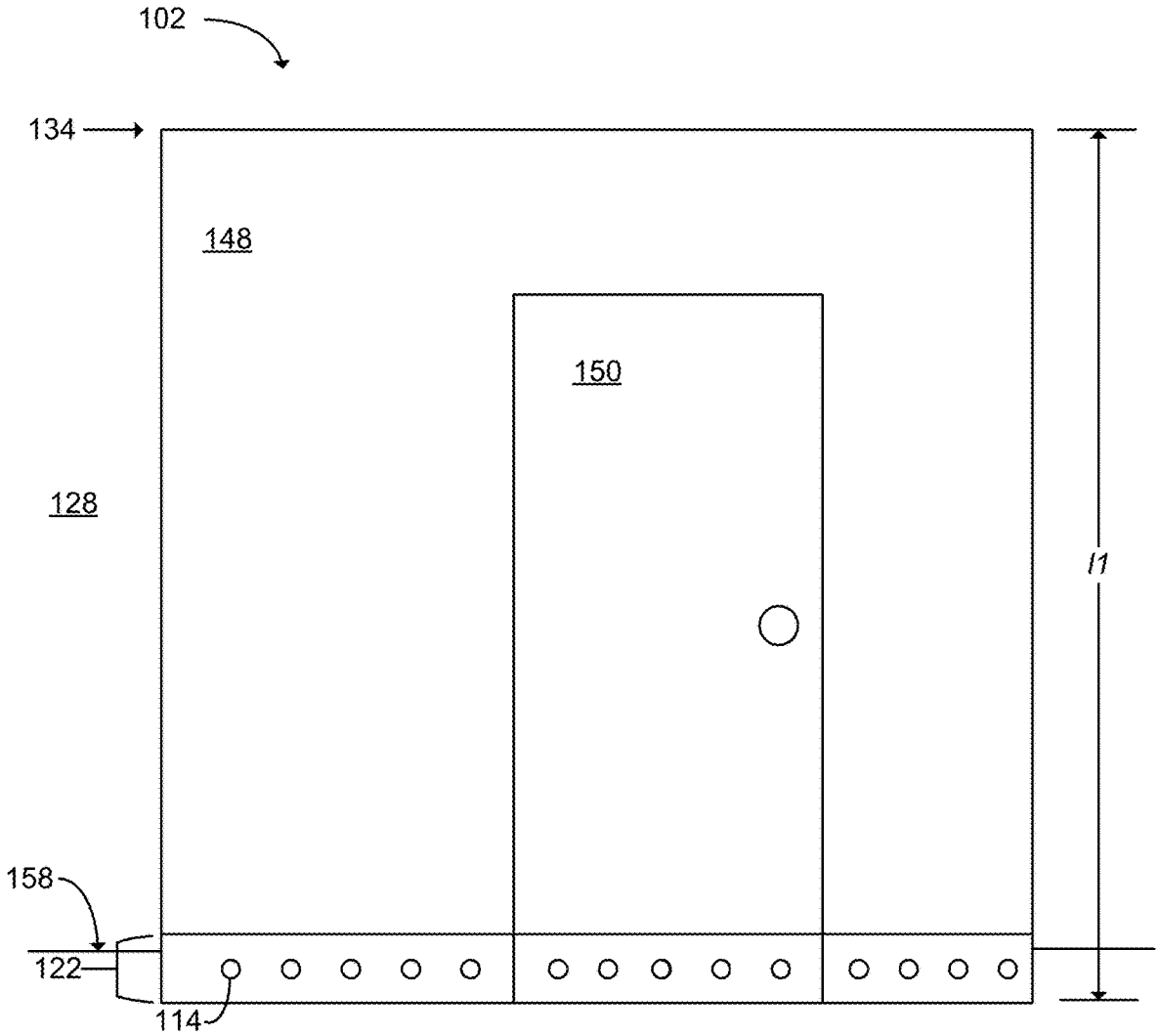
FIG. 1 illustrates a front view of a system for gas ventilation, according to one or more examples of the present disclosure.

FIG. 1 illustrates a front view of an enclosure 102 for ventilating gas, according to one or more examples of the present disclosure. As shown in FIG. 1, the enclosure 102 includes a top side 134, a number of exterior walls 148 having a length l1 and a door 150 providing access to the enclosure 102. An exterior wall includes a lower portion 122 having a number of exterior wall apertures 114*a*, . . . , 114*n*, which may be referred to herein, individually or collectively, as "114." The exterior wall apertures 114 allow gas to travel from an exterior 128 of the enclosure 102 and into the enclosure 102.

Figure 2A:
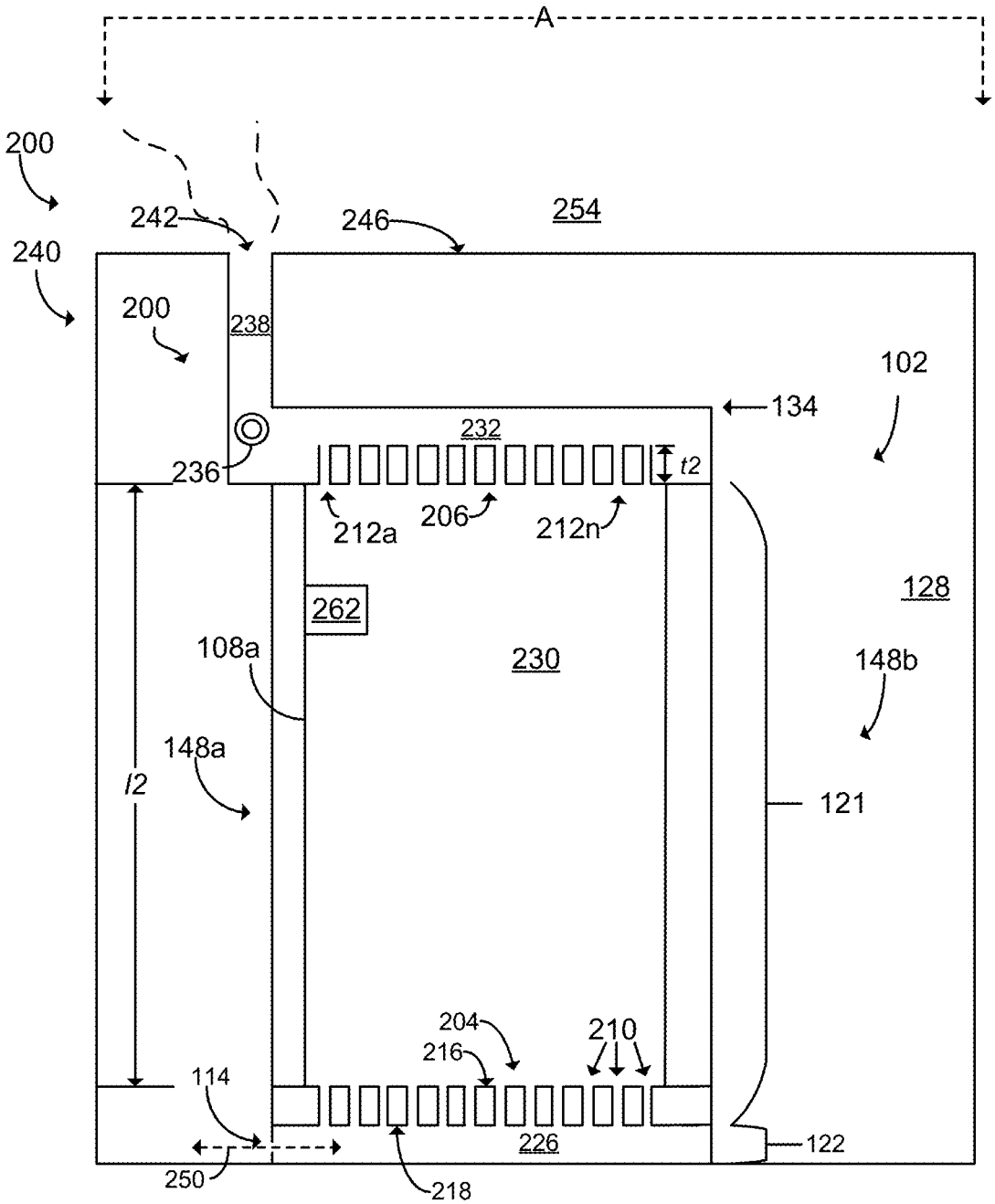
FIG. 2A illustrates a cross-section of a system for gas ventilation, according to one or more examples of the present disclosure.

FIG. 2A illustrates a cross-section of a system 200 for gas ventilation in a plane 'A', according to one or more examples of the present disclosure. As shown in FIG. 2A, the system 200 includes an enclosure 102 to be positioned within an indoor environment 240, a gas flow element 236, and a duct 238. The enclosure 102 is substantially as described above with reference to FIG. 1. The enclosure 102 includes a floor 204, a ceiling 206, interior walls 108, and exterior walls 148. The exterior walls 148 include exterior wall apertures 114. The floor 204 includes floor apertures 210. The ceiling 206 includes ceiling apertures 212. In some examples, the enclosure 102 is a room within another room of an indoor environment 240. For example, the indoor environment 240 is a building, such as a residential, educational, commercial, and/or industrial building. While FIG. 2A depicts the enclosure 102 located within the indoor environment 240, in other examples a similar enclosure 102 may be a standalone structure located in an outdoor environment.

Gas from an exterior 128 of the enclosure travels through the exterior wall apertures 114 to one or more channels 226 and/or directly into the interior 230 of the enclosure. The gas then travels towards the ceiling 206, bringing unwanted gas from the interior 230 with it through the ceiling apertures 212 and into the passage 232. The gas travels through the passage 232, through a connected duct 238, and out of a vent 242 to an exterior 254 of the indoor environment 240.

As used herein, the term "exterior wall" refers to a wall and/or wall surface that is closer to an exterior 128 of the enclosure 102 than a corresponding "interior wall" is to the exterior 128 of the enclosure. Likewise, the term "interior wall" refers to a wall and/or wall surface that is closer to an interior of the enclosure 102 (e.g., interior 230 shown in FIG. 2A) than a corresponding exterior wall 148 is to the interior of the enclosure 102.

The enclosure 102 is part of a gas ventilating system (e.g., system 200 of FIG. 2A) that includes a gas flow element 236 positioned to actively move gas from an interior 230 of the enclosure 102 to an exterior 254 of the environment 240 of the enclosure 102. Thus, examples of the present disclosure include methods and systems for ventilating gas from an interior 230 of the enclosure 102 to an exterior 254 of an indoor environment 240, allowing users to participate in activities within the enclosure 102 that may emit toxic and/or unpleasant gases and/or pollutants without causing discomfort to other occupants of or damaging the indoor environment 240. For example, gases to be ventilated out of the enclosure 102 include, but are not limited to, smoke, gas containing unpleasant odors, stale air, ammonia, and/or carbon monoxide. As used herein, the term "gas" is not limited to the above examples and includes any type of gas. Moreover, the term pollutant refers to a contaminant or impurity in the gasses of the interior environment 240. Such contaminants or impurities may include, but are not limited to, smoke, dust, aerosolized particles, particulate matter, volatile organic compounds, off-gasses, and the like.

For example, a user smokes a cigarette within the enclosure 102, and the system 200 moves the emitted smoke from the interior 230 of the enclosure 102 to an exterior 254 of an indoor environment 240 in which the enclosure is positioned 102 to help minimize exposure to the smoke in other portions of the indoor environment 240. Other activities performed within the enclosure 102 that could emit gases include, for example, using cleaners emitting harsh chemicals, welding, dressing and/or butchering animals, soldering, crafting, cooking, defecation, waste storage and/or waste disposal. In some examples, the system 100 does not include filters to remove contaminants from the gas.

In some examples, the gas flows through the apertures 114 through passive ventilation, such as buoyancy-driven ventilation. The ambient air on the exterior 128 of the enclosure 102 is of a lower temperature than air in an interior 230 of the enclosure 102. Burning tobacco within the enclosure 102 increases the temperature of air in the interior 230 relative to air on the exterior 128. The colder air enters the enclosure 102 through the exterior wall apertures 114, and the gas on the interior 230 rises toward a top side 134 of the enclosure 102.

Although not shown in FIG. 2A, in some examples, the gas flows through the exterior wall apertures 114 due at least in part to active ventilation. A component on the exterior 128 of the enclosure 102 helps to move gas through the exterior wall apertures 114. For example, a fan blows gas from the exterior 128 to the interior 230. Similarly, the indoor environment 240 and/or the exterior 128 of the enclosure 102 may be kept at a higher ambient pressure as compared to the interior 230 of the enclosure 102, thereby causing gas to move from the exterior 128 of the enclosure 102 to the interior 230 of the enclosure 102 due to a pressure differential.

The interior walls 108 extend along a length l2 of the interior walls 108, from the ceiling 206 to at least the floor 204. In some examples, the length l2 of each interior wall 108 is not less than three feet and not greater than twenty feet. In some examples, an exterior wall 148 has a length l1 that is greater than a length l2 of a corresponding interior wall 108. In some examples, the length l1 of each exterior wall 148 is not less than four feet and not greater than 22 feet. The interior wall 108 extends along its length l2 from the ceiling 206 to the first surface 216, and the exterior wall 148 extends from a higher point (e.g., the top side 134 of the enclosure) to below the first surface 216 (e.g., below the second surface 218 and/or to the floor 152 of the indoor environment 240). In some examples, the exterior wall 148 extends from a top side 134 of the enclosure 102 to a floor or ground 152 of an indoor environment 240 in which the enclosure 102 is positioned.

In some examples, the exterior wall 148 is a first wall surface, and the interior wall 108 is a second wall surface opposite to the first wall surface. In some examples, an insulating layer is disposed between an interior wall 108 and an exterior wall 148. As shown in FIG. 2A, in some examples, the exterior wall 148 includes a first portion 121 extending from at least the ceiling 206 of the enclosure 102 to at least the first surface 216. The first portion 121 is substantially parallel to the interior wall 108*a*. In some examples, the first portion 121 extends along the length l2 of the interior wall 108*a*.

In some examples, the exterior wall 148 includes a second portion 122 below the first surface 216. For example, as shown in FIG. 2A, the second portion 122 begins at the second surface 218. In some examples, the first portion 121 and the second portion 122 are continuous. In one example, the second portion 122 includes a baseboard of the exterior wall 148. In some examples, the second portion 122 is made of a material that is different from a material of which the first portion 121 is made. For example, the second portion 122 includes at least one of: rubber, vinyl, wood, medium-density fiberboard, laminate, fiber cement, plastic, metal, or any combination thereof.

Figure 2B:
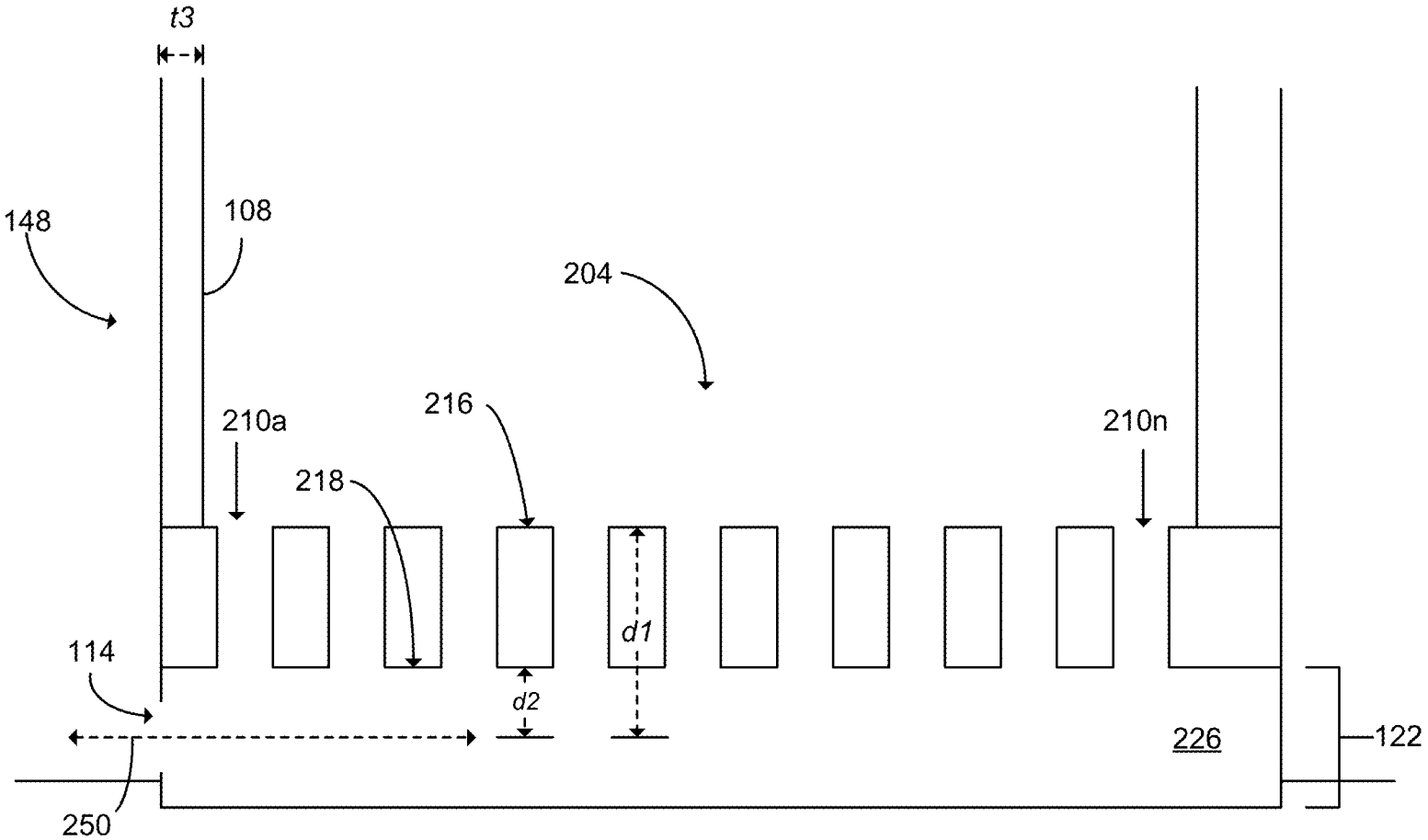
FIG. 2B illustrates a magnification of the system of FIG. 2A, according to one or more examples of the present disclosure.

FIG. 2B is a magnified view of FIG. 2A. As shown in FIG. 2B, the exterior wall 148 includes at least one exterior wall aperture 114. The exterior wall apertures 114 extend through a thickness t3 of the exterior wall 148 and the corresponding interior wall 108. Gas flows from an exterior 128 of the enclosure 102 to a channel 226 and/or an interior 230 of the enclosure 102 through the exterior wall apertures 114. In some examples, the channel 226 is oriented in a plane that is perpendicular to both of the virtual planes 'A' and 'B.'

The floor 204 includes a first surface 216 and a second surface 218 opposite the first surface 216. The exterior wall apertures 114 are positioned in close proximity to the floor 204. For example, the exterior wall apertures 114 are positioned such that at least one of (i) a distance d1 between the first surface 216 and a center 250 of the aperture 114 and (ii) a distance d2 between the second surface 218 and the center 250 of the aperture 114 is not greater than twenty percent of the total length l1 of the exterior wall 148. In some examples, as shown in FIGS. 1 and 2A-2B, each of the exterior wall apertures 114 is positioned on the second portion 122, which is below the floor 204. However, examples of the present disclosure are not so limited. In some examples, the exterior wall apertures 114 extend through the exterior wall 148 and lengthwise through the floor 204, intersecting the floor apertures 210. In other examples, at least some of the exterior wall apertures 114 are positioned above the first surface 216 (i.e., on the first portion 121) and extend through both the exterior wall 148 and the interior wall 108. In some examples, a distance d3 between a floor 158 of the indoor environment 240 and a center 250 of each exterior wall aperture 114 is not less than 0.5 inches and not greater than 5 inches. In some examples, the distance d1 between the center 250 and the first surface 216, the distance d2 between the center 250 and the second surface 218, and the distance d3 between the center 250 and the floor 158 are equivalent for each exterior wall aperture 114. In other examples, at least one of the distances d1, d2, and/or d3 varies between at least two exterior wall apertures 114.

Although not illustrated in the Figures, in some examples, at least a portion of the exterior wall apertures 114 are positioned on the first portion 121. In such examples, at least a portion of the exterior wall apertures 114 are positioned above the first surface 216. If an exterior wall aperture 114 is positioned on the first portion 121, the exterior wall aperture 114 also extends through the interior wall 108. As shown in FIG. 1, in some examples, at least a portion of the exterior wall apertures 114 are positioned on the door 150. In some examples, the door 150 ends at the floor 204 of the enclosure 102, and at least a portion of the exterior wall apertures 114 are positioned below the door 150.

In some examples, the area of each exterior wall aperture 114 is not less than 0.01 square inches and not greater than 0.1 square inches. In some examples, the exterior wall apertures 114 are substantially circular in shape, as shown in FIG. 1. However, examples of the present disclosure are not so limited. In some examples, the exterior wall apertures 114 are slits and/or openings in the exterior wall 148 of other shapes, such as squares, rectangles, triangles, asymmetrical shapes, or any combination thereof.

In some examples, the exterior wall apertures 114 are positioned on a lower portion 122 of the exterior wall 148 and around a perimeter of the enclosure. For example, the exterior wall apertures 114 are positioned in a single row along a lower portion 122 of the exterior wall 148 and are substantially aligned with wall apertures of another exterior wall 148 of the enclosure. In some examples, each exterior wall apertures 114 is equidistant from two adjacent exterior wall apertures 114.

As shown in FIG. 1, the floor 204 is perforated. For example, the floor 204 includes one or more floor apertures 210. Each of the floor apertures 210 extends through a thickness t1 of the floor 204 from the first surface 216 to the second surface 218. In some examples, the floor 204 includes not less than 50 apertures per square foot. For example, the floor 204 includes multiple 4×8" sections, and each 4×8" section includes not less than 3000 and not greater than 4000 floor apertures 210.

In some examples, an insulating layer is disposed between the first surface 216 and the second surface 218. The floor 204 is made of materials including, but not limited to: linoleum, wood, glass, porcelain, stone, cork, metal, concrete, brick, granite, bamboo, plywood, marble, synthetic fibers, or any combination thereof. In some examples, the first surface 216 is carpeted.

The ceiling 206 includes ceiling apertures 212*a*, . . . , 212*n*, which may be referred to herein individually or collectively as "212." The ceiling apertures 212 extend through a thickness t2 of the ceiling 206, connecting the interior 230 to a passage 232.

In some examples, each of the floor apertures 210 is substantially aligned with at least one ceiling aperture 212 in a plane 'A' and/or another plane substantially perpendicular to the floor 204. Each of the floor apertures 210 includes at least one point that is coplanar, at least in the plane 'A', with a point of at least one ceiling aperture 212. In some examples, a quantity of ceiling apertures 212 is equal to a quantity of floor apertures 210. In some examples, the ceiling 206 includes not less than 50 apertures per square foot. For example, the ceiling 206 includes multiple 4×8" sections, and each 4×8" section includes not less than 3000 and not greater than 4000 ceiling apertures 212.

As shown in FIG. 2A, in some examples, the enclosure 102 includes a passage 232 between the ceiling 206 and a top side 134 of the enclosure 102. The passage 232 is substantially hollow, allowing gas to flow from the ceiling apertures 212 into the duct 238. In some examples, the passage 232 is adjacent to a ceiling aperture 212. Each ceiling aperture 212 is positioned to allow gas pulled by a gas flow element 236 to travel from an interior 230, through at least one ceiling aperture 212, and through the passage 232. In some examples, the ceiling apertures 212 are spaced equidistant from each other across the ceiling 206.

In some examples, the system 200 is a fan-assisted passive ventilation system. The exterior wall apertures 114 allow for passive flow of gas from the exterior 128. However, the system may also include the gas flow element 236 that pulls gas within the enclosure 102 through ceiling apertures 212 of the enclosure 102. The gas flow element 236 is connected to or positioned within the passage 232. The gas flow element 236 pulls gas from an interior 230 of the enclosure 102 and/or from the channels 226, through the ceiling apertures 212, into the passage 232, and through a duct 238. The gas flow element 236 includes, for example, an exhaust fan. The exhaust fan creates negative pressure within the enclosure 102, which pulls gas out of the interior 230.

In some examples, the gas flow element 236 includes one or more exhaust fans with adjustable speeds, or revolutions per minute ("RPM"). In some examples, the system 100 includes sensors (e.g., motion sensors, cameras, door sensors, etc.) to determine the presence of occupants within the enclosure and a controller to adjust the RPMs of the gas flow element 236 accordingly. In other examples, the system 100 includes a component, such as a user interface of a control panel and/or a mobile application, that receives input from a user regarding the number of occupants in the enclosure. For example, the system 100 receives an input through a control panel within the enclosure 102 that there is a single occupant within the enclosure 102. A controller of the system 100 sets the RPMs of the gas flow element(s) 236. The controller later receives data from the sensors indicating the presence of an additional occupant and increases the RPMs of the gas flow element(s) 236.

In some examples, the multiple speeds of the gas flow element 236 allow for the speed to be adjusted to accommodate for different sizes of enclosures 102. For example, the enclosure 102 is expanded by adding additional sections of floor 204, additional sections of the ceiling 206, additional sections of interior walls 108, and additional sections of exterior walls 148. The speed of the gas flow element 236 is increased to remain effective in a larger enclosure 102.

In some examples, the enclosure 102 includes a smoke detector 262 in communication with the controller for the gas flow element 236. The controller adjusts a speed of the gas flow element 236 based at least in part on a level of smoke detected in the room. For example, the smoke detector 262 detects a threshold level of smoke within the enclosure 102 and transmits a signal to the controller for the gas flow element 236. Some examples include a detector 262 configured to detect other types of harmful gases, such as carbon monoxide, volatile organic compounds, airborne particulate matter, and/or radon. In response, the controller for the gas flow element 236 increases RPM for the gas flow element 236. In some examples, the controller for the gas flow element 236 increases RPM for the gas flow element 236 to a pre-determined level.

In some examples, the gas flow element 236 is configured to rotate at a speed sufficiently low to create a gas flow rate of less than 0.2 feet per second. For example, the gas flow element 236 includes a default RPM setting that causes gas within the enclosure 102 to flow at a rate of approximately 0.15 feet per second. In some examples, the system 200 includes a device configured to measure the gas flow rate within the enclosure 102. For example, the device includes, but is not limited to, a mass flow meter, an orifice plate, a venturi tube, a pilot tube, and/or an ultrasonic flow meter positioned within the duct 232. In some examples, the device is in communication with the controller, and the controller determines any needed adjustments to the gas flow elements 236 based at least in part on the gas flow rate.

Although FIG. 2A shows the gas flow element 236 positioned within a passage 232 of the enclosure 102, examples of the present disclosure are not so limited. In some examples, the gas flow element 236 is positioned below the floor 204 (e.g., within the base 224 of FIG. 2C) and is configured to push gas up through the floor apertures 210 and through the ceiling apertures 212.

In some examples, the duct 238 is connected to a vent 242 of a ceiling 246 and or a wall 344 of the indoor environment 240. As such, gas travels through the duct 238, through the vent 242, and out of the indoor environment 240. In some examples, the vent 242 is an exhaust vent. In some examples, the vent 242 is similar to a dryer vent. The vent 242 is made of a metal and/or plastic material. In some examples, the vent 242 is substantially straight and free from bends. The vent 242 has a width that is greater than 2 inches and less than 10 inches. For example, the vent 242 is circular and has a diameter of 6 inches. In some examples, the duct 238 is a flexible exhaust duct.

In some examples, the enclosure 102 is modular and expandable. Each of the interior walls 108, exterior walls 148, floor 204, and ceiling 206 are configured to be removably connected to another similar element. For example, the enclosure 102 is expandable by connecting each interior wall 108 to an additional interior wall segment, the floor 204 to an additional floor segment, and/or the ceiling 206 to an additional ceiling segment.

Figure 2C:
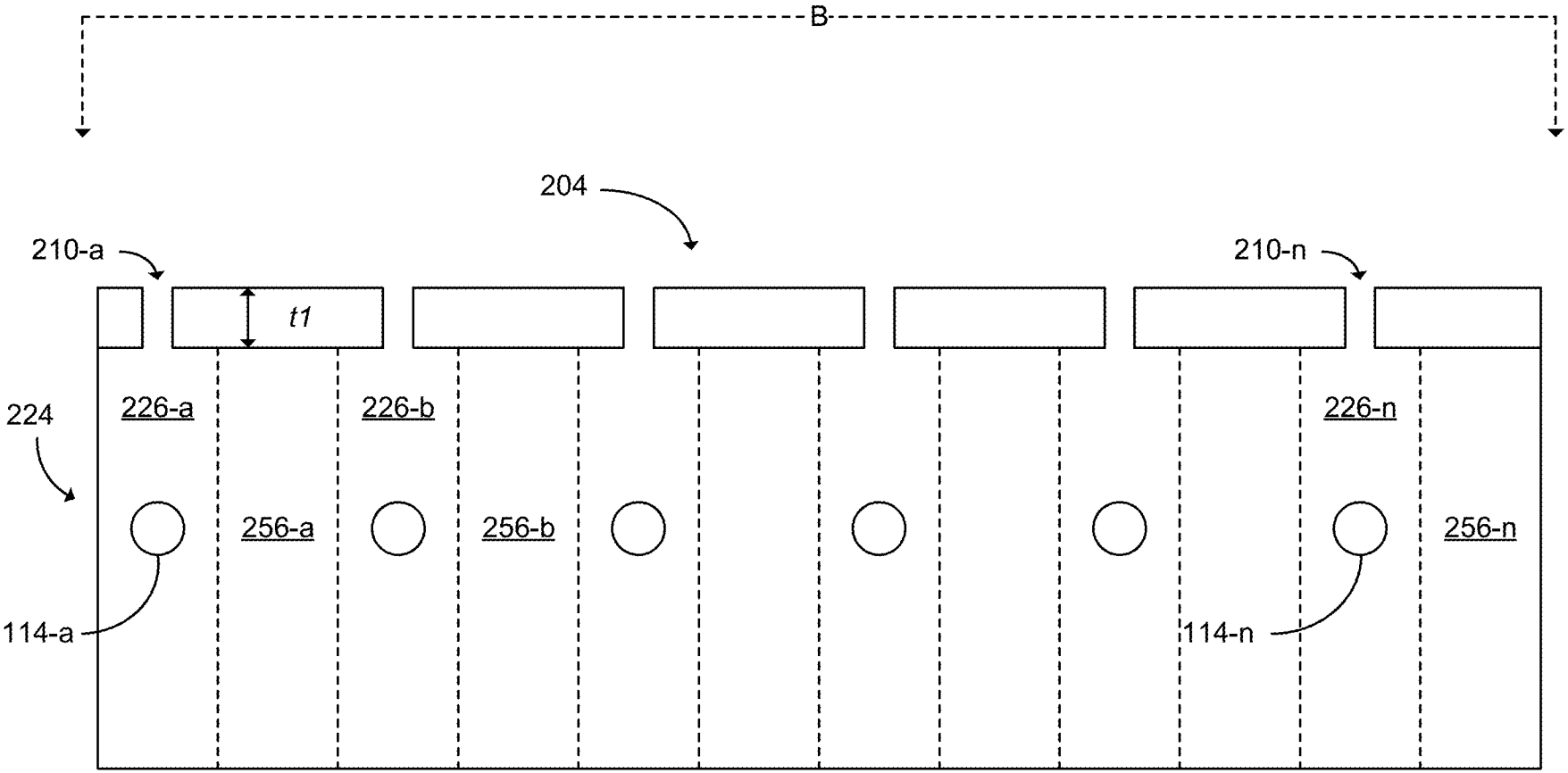
FIG. 2C illustrates a cross-section of a floor and base of an enclosure for gas ventilation, according to one or more examples of the present disclosure.

FIG. 2C is a view of a cross-section of a floor 204 and base 224 of the enclosure 102 in a plane 'C' substantially perpendicular to the floor 204, to the plane 'A' of FIG. 2A, and to the plane 'B' of FIG. 2B. As shown in FIG. 2C, in some examples, the enclosure 102 includes a base 224 on which the floor 204 is positioned. In some examples, the base 224 includes a number of supports 256 for the floor 204, such as joists.

The base 224 includes a number of channels 226*a*, . . . , 226*b*, which may be referred to herein, individually or collectively, as "226." For example, the channels 226 may be spaces between supports 256 of the base 224. However, examples of the present disclosure are not so limited. In some examples, the channels 226 are channels within the supports 256 rather than between the supports 256. In some examples, the channels 226 are substantially aligned with rows of the floor apertures 210.

In some examples, each channel 226 connects an exterior wall aperture 114 and at least one floor aperture 210. Each of the exterior wall apertures 114 is configured to allow gas to pass from an exterior 128 of the enclosure 102 into at least one of an interior 230 of the enclosure 102 and a channel 226. For example, gas that flows through the exterior wall aperture 114 and into the channel 226 may be pulled and/or flow up through the floor aperture 210 and into the interior 230 of the enclosure 102.

Figure 3A:
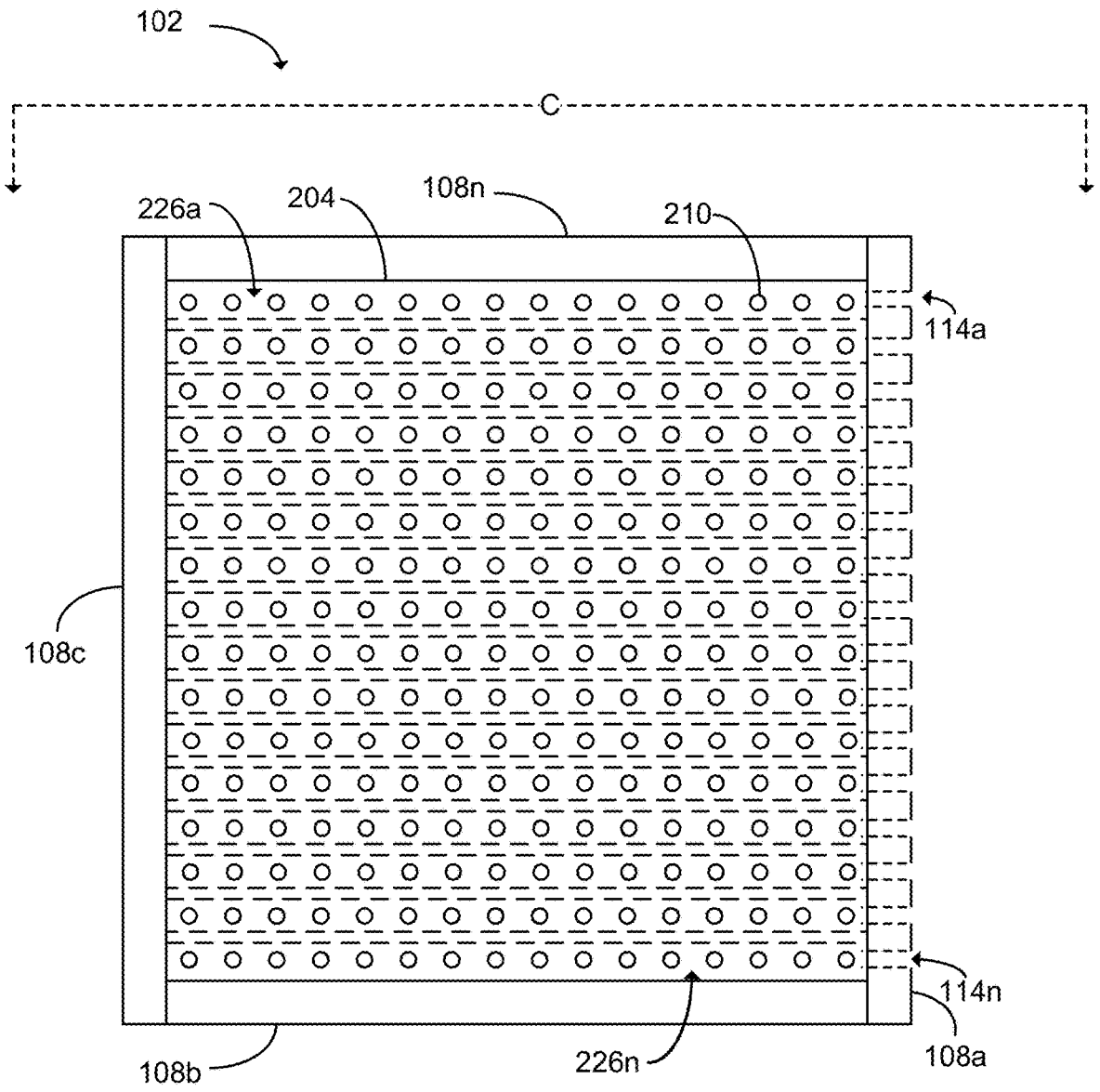
FIG. 3A illustrates a cross-section of an enclosure for gas ventilation, according to one or more examples of the present disclosure.
Figure 4:
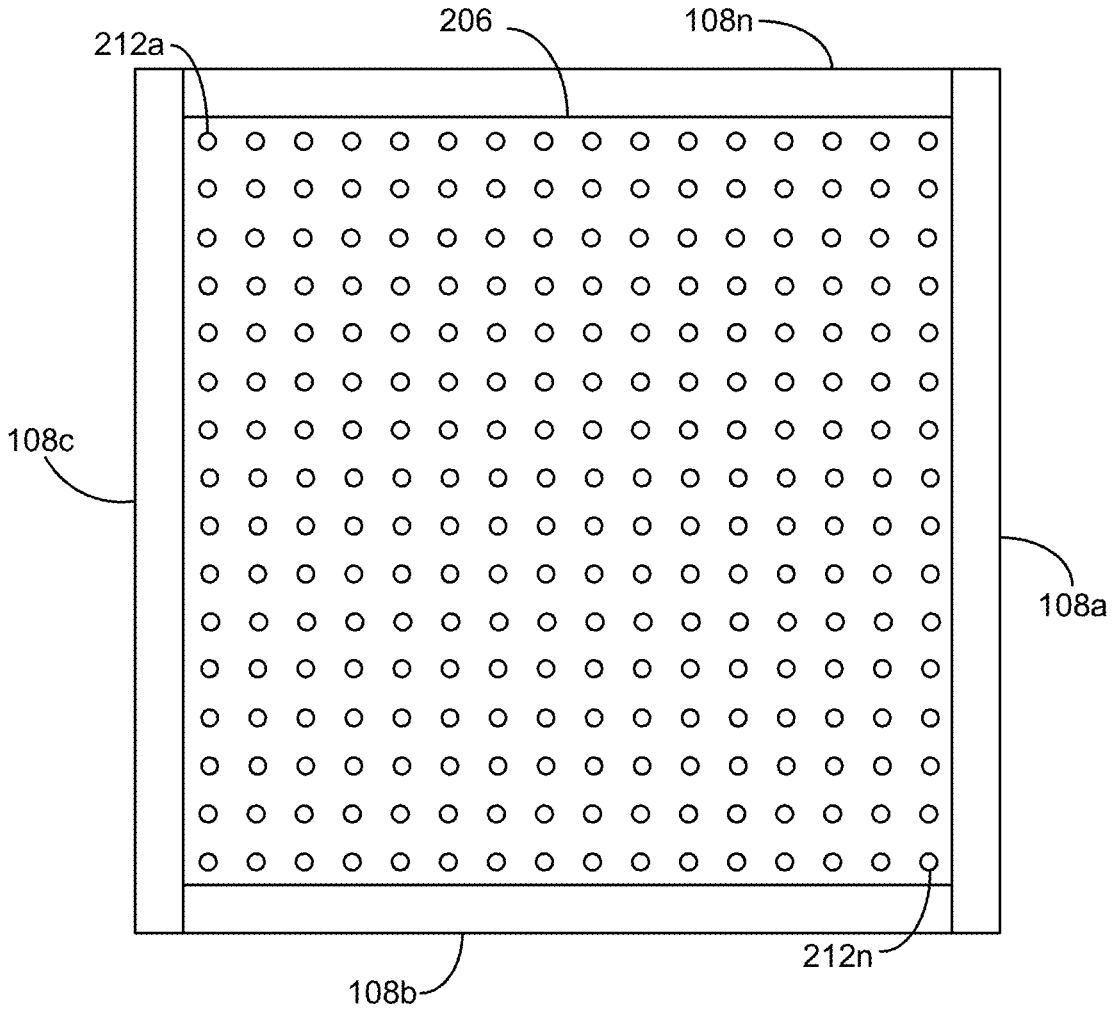
FIG. 4 illustrates a bottom view of a ceiling of an enclosure for gas ventilation, according to one or more examples of the present disclosure.

FIG. 3A illustrates a top view of a floor 204 of an enclosure 102 in a plane "C' substantially perpendicular to the planes 'A' and 'B', according to one or more examples of the present disclosure. As illustrated in FIG. 4, in some examples, the floor 204 is enclosed by interior walls 108 and exterior walls 148. At least one exterior wall 148 includes a number of exterior wall apertures 114. The floor 204 includes a number of rows and columns of floor apertures 210. In some examples, the floor apertures 210 are equidistant from each other.

As shown in FIG. 3A, in some examples, the enclosure 102 is substantially square in shape and includes four interior walls 108 and four exterior walls 148. In some examples, the enclosure 102 is modular, and the floor 204 includes two or more pieces that fit together to form a larger floor 204. In such examples, the interior walls 108 and exterior walls 148 are also configured to mate with each other to increase the area covered by the enclosure 102. The enclosure 102 may be of any suitable shape and is not limited to rectangular shapes.

Figure 3B:
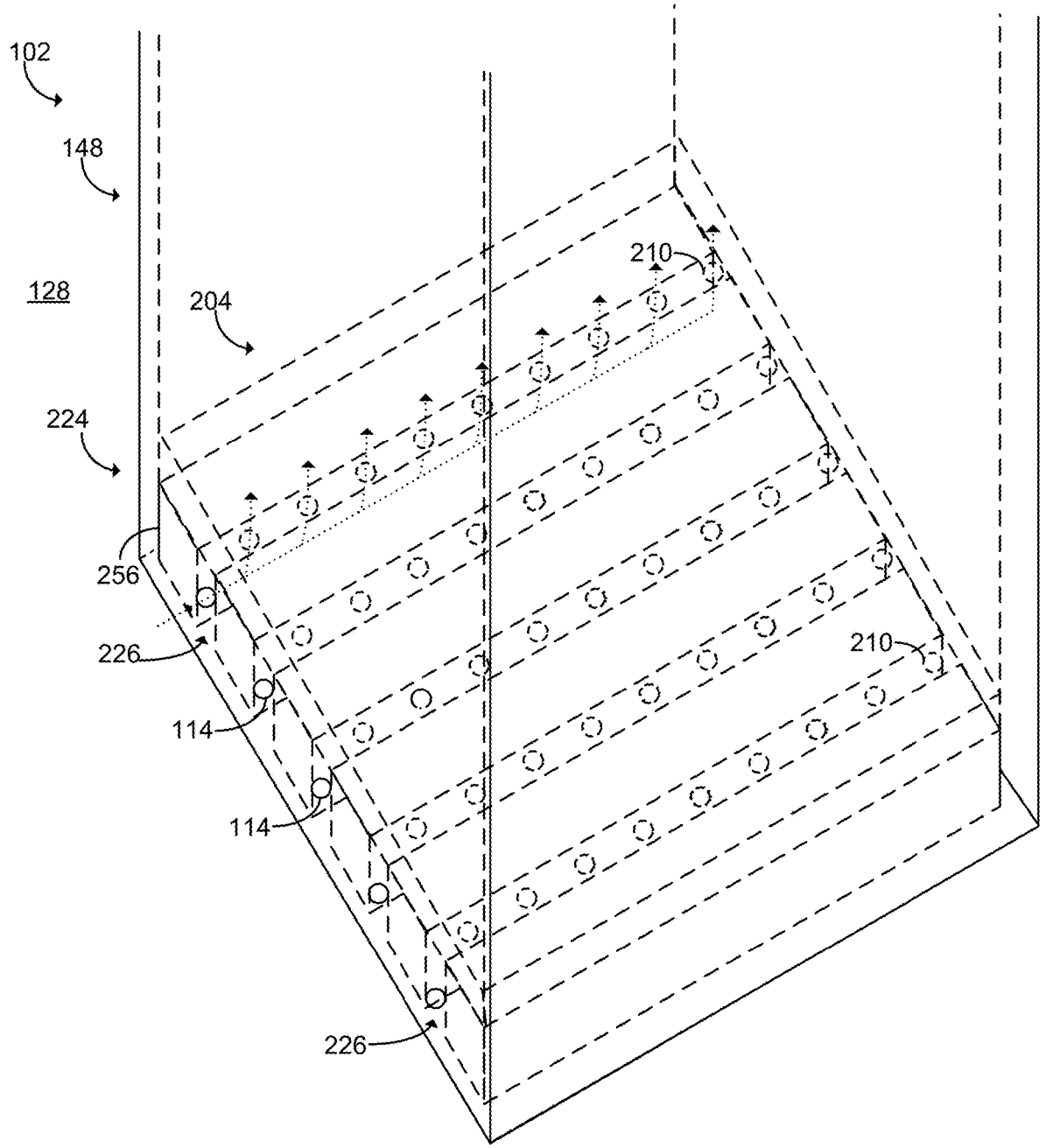
FIG. 3B illustrates a perspective view of an enclosure for gas ventilation, according to one or more examples of the present disclosure.

FIG. 3B illustrates a perspective view of a floor 204 and base 224 of an enclosure 102, according to one or more examples of the present disclosure. As shown by the dotted lines in FIG. 3B, gas travels from an exterior 128 of the enclosure 102, through the exterior wall apertures 114, into the channels 226, and up through the floor apertures 210.

FIG. 4 illustrates a bottom view of a ceiling 206 of a gas ventilation enclosure 102, according to one or more examples of the present disclosure. As shown in FIG. 4, in some examples, the ceiling 206 includes multiple ceiling apertures 212 that are arranged in rows and columns. In some examples, the ceiling apertures 212 are circular in shape. However, examples of the present disclosure are not so limited. In some examples, the ceiling 206 is shaped substantially similarly to the floor 204. In some examples, the ceiling 206 is rectangular. In some examples, the arrangement of the ceiling apertures 212 matches an arrangement of the floor apertures 210 such that each ceiling aperture 212 is coplanar with at least one floor aperture 210 in a plane perpendicular to the floor (e.g., plane 'A'). For example, the quantity of ceiling apertures 212 is equal to the quantity of floor apertures 210, and each of the ceiling apertures 212 and floor apertures 212 are arranged in an equal number of rows and columns.

Figure 5A:
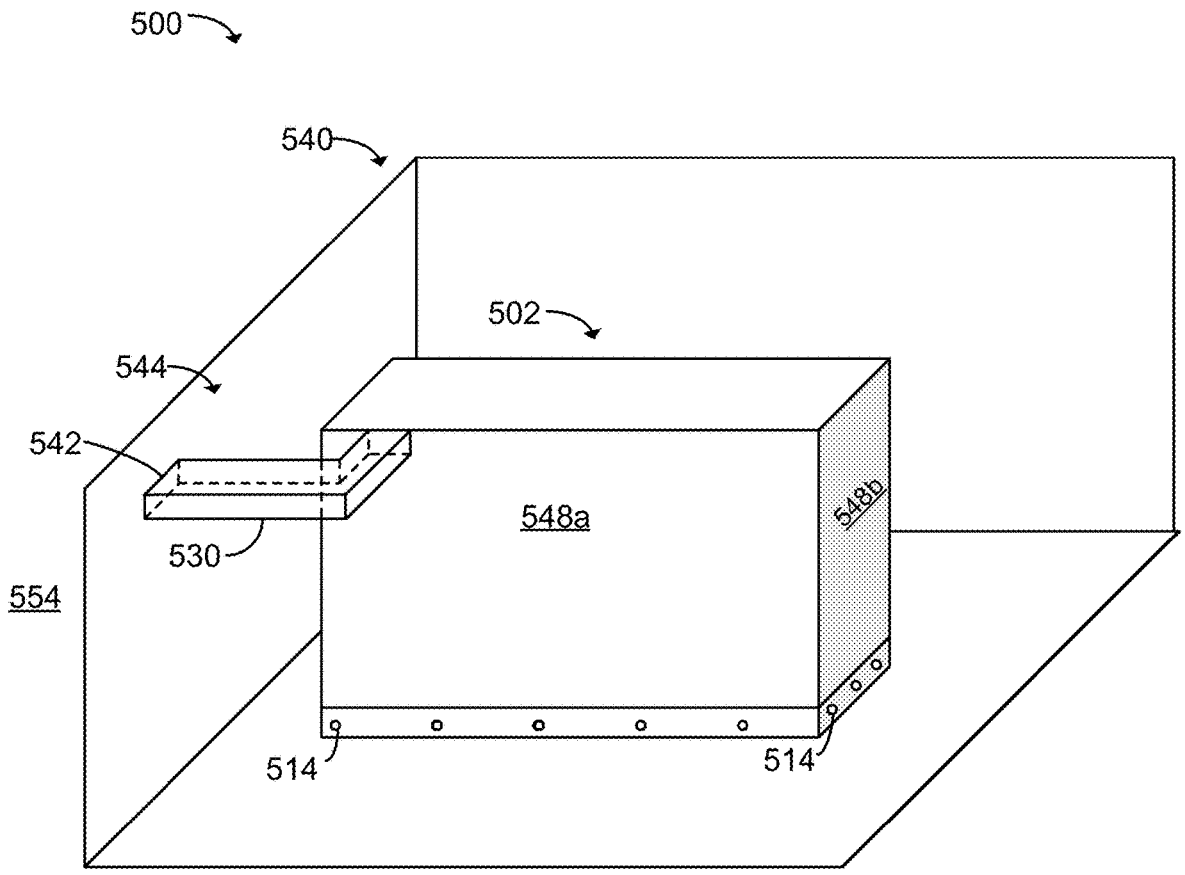
FIG. 5A illustrates a perspective view of a system for gas ventilation, according to one or more examples of the present disclosure.

FIG. 5A illustrates a perspective view of system 500 for gas ventilation, according to one or more examples of the present disclosure. In some examples, the system 500 is an example of the system 200 of FIG. 2A, and the enclosure 502 is an example of the enclosure 102 of FIG. 2A. As shown in FIG. 5A, the system 500 includes an enclosure 502 within an indoor environment 540. The system 500 includes exterior walls 548 having exterior wall apertures 514. Gas flows through the exterior wall apertures 514 and into the enclosure 502. The system 500 ventilates gas from the enclosure 502, through a wall duct 530, out of a wall vent 542, and to an exterior 554 of the indoor environment 540 (e.g., outdoors). In some examples, a wall duct 530 is connected to a vent 542 of a wall 548*a* of the indoor environment 540 rather than to a ceiling, as shown in FIG. 2A. In some examples, the indoor environment 540 is a structure, such as a building, and the enclosure 102 is in an interior of that structure. For example, the indoor environment 540 is a building, and the enclosure 502 is a room within the building.

Figure 5B:
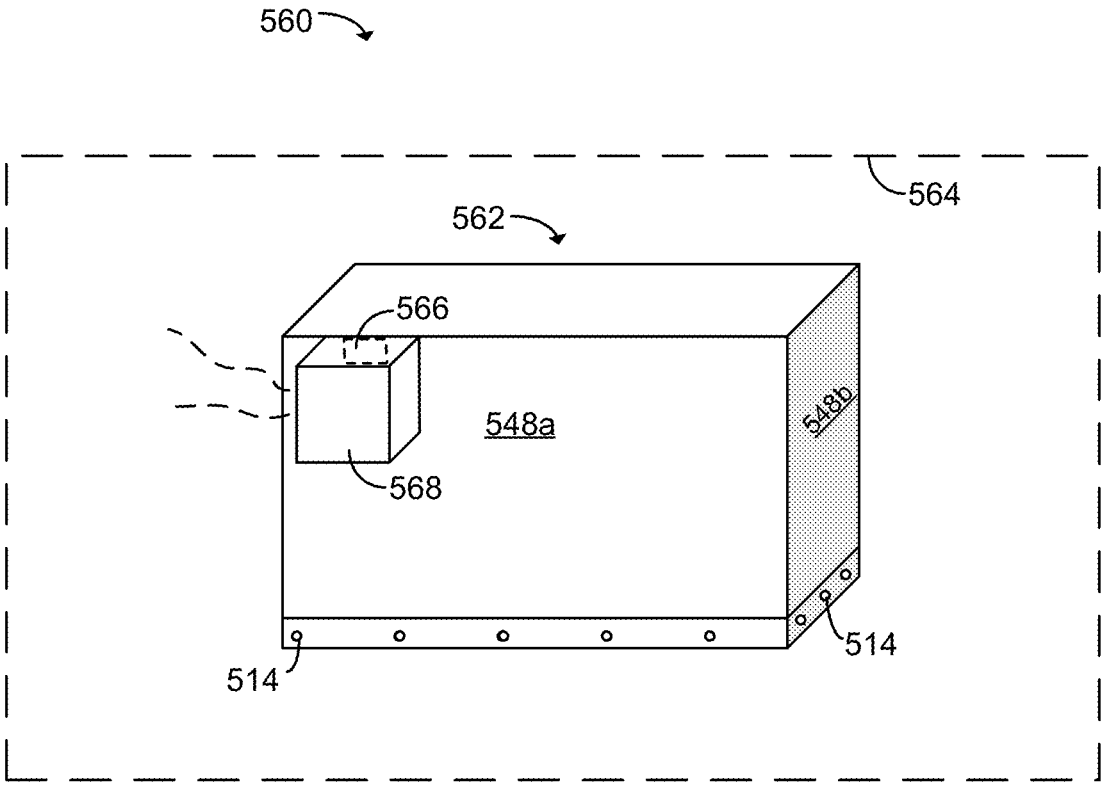
FIG. 5B illustrates a perspective view of another system for gas ventilation, according to one or more examples of the present disclosure.

FIG. 5B illustrates a perspective view of system 560 for gas ventilation, according to one or more examples of the present disclosure. In some examples, the enclosure 562 is an example of the enclosure 102 of FIG. 1 and/or FIG. 2A. As shown in FIG. 5B, the system 560 includes an enclosure 562 that is a standalone enclosure located in an outdoor environment 564. The system 560 includes exterior walls 548 having exterior wall apertures 514. Gas flows from the outdoor environment 564 through the exterior wall apertures 514 and into the enclosure 562. The system 560 ventilates gas from the enclosure 502, through a vent 566, and to the outdoor environment 564 (e.g., outdoors). In the depicted example, the vent 566 is located in an upper portion of the wall 548*a* of the enclosure 562, rather than to a ceiling of the enclosure as discussed above with reference to FIG. 2A. In other examples, the vent 566 may be located in the ceiling/roof of the enclosure 562.

In some examples, a gas flow element 568 is attached to the vent 566. In such examples, the gas flow element 568 is an example of the gas flow element 236. As described above, the gas flow element 568 is configured to pull gas from an interior of the enclosure, through the number of ceiling apertures, through the passage, and into the duct. While depicted as a discrete unit located at the exterior of the wall 548*a*, in other examples, the gas flow element 568 may be located inside the enclosure 562 or may be located within the wall 548*a*. For example, the gas flow element 568 may be co-located with (e.g., built into) the vent 566.

Figure 6:
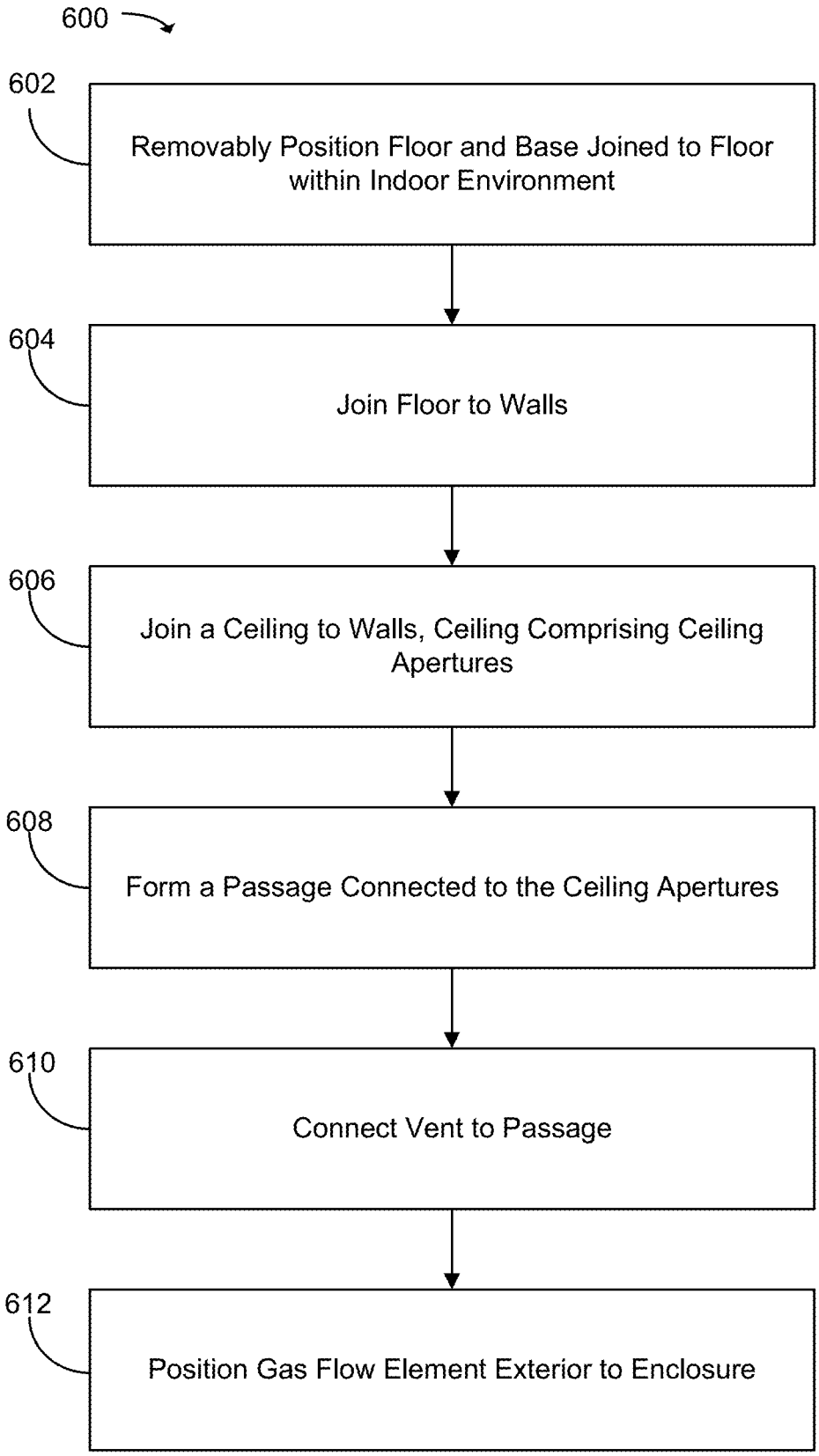
FIG. 6 is a schematic flow chart of a method of manufacturing a system for gas ventilation, according to one or more examples of the present disclosure.

FIG. 6 is a schematic flow chart of a method 600 of manufacturing a system for gas ventilation (e.g., system 200), according to one or more examples of the present disclosure.

The method 600 includes forming an enclosure 102. For example, the method 600 includes forming an enclosure 102 by removably positioning 602 a floor 204 and a base 224 joined to the floor 204. In some instances, the enclosure 102 may be formed within an indoor environment 240. In other instances, the enclosure 102 may be formed within an outdoor environment. The floor 204 includes floor apertures 210. In some examples, the method includes forming the floor apertures 210 in the floor before or after the positioning 602.

The method 600 includes joining 604 the floor 204 to interior walls 108. The interior walls 108 extend, along a length l2 of the interior walls 108, from the ceiling 206 to at least the floor 204. Joining 604 the floor 204 to the interior walls 108 forms an exterior wall 148. In some examples, the exterior wall 148 includes a first portion 121, a second portion 122 extending below the first surface 216, and at least one exterior wall aperture 114 extending through a thickness of the exterior wall 148. Each of the exterior wall apertures 114 is located no more than a distance, from at least one of a first surface 216 and a second surface 218 of the floor, equal to twenty percent of the total length l1 of the exterior wall 148. In some examples, the method 600 includes forming the exterior wall apertures 114 prior to joining 604 the floor 204 to the interior walls 108 and the exterior walls 148.

The method 600 includes joining 606 the ceiling 206 to at least one of the interior walls 108 and the exterior walls 148. In some examples, the method 600 includes forming ceiling apertures 112 in the ceiling 206 before and/or after the joining 606. The method 600 includes forming 608 a passage 232 connected to the ceiling apertures 112. The method 600 includes connecting 610 a duct 238 to the passage 232. The method 600 includes connection the duct 238 to a vent 242.

The method 600 includes positioning 612 a gas flow element 236 exterior to the enclosure 102. For example, the method 600 includes positioning 610 the gas flow element 236 within the duct 238.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." Moreover, unless otherwise noted, as defined herein a plurality of particular features does not necessarily mean every particular feature of an entire set or class of the particular features.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent to another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagrams included herein are generally set forth as logical flow chart diagrams. As such, the depicted order and labeled steps are indicative of one example of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described examples are to be considered in all respects only as illustrative and not restrictive. All changes which come within the meaning and range of equivalency of the claims are to be embraced within their scope.

What is claimed is:

1. An enclosure, comprising:
- a floor comprising:
  - a first surface;
  - a second surface opposite the first surface; and
  - floor apertures, wherein each one of the floor apertures extends through a thickness of the floor from the first surface to the second surface;
- a ceiling comprising ceiling apertures; and
- interior walls extending, along a length of the interior walls, from the ceiling to at least the floor; and
- a plurality of exterior walls, each exterior wall of the plurality of walls comprising:
  - a first portion extending from at least the ceiling of the enclosure to at least the first surface;
  - a second portion extending below the first surface; and
  - a plurality of exterior wall apertures extending through a thickness of the exterior wall and located no more than a distance, from at least one of the first surface and the second surface of the floor, equal to twenty percent of a total length of the exterior wall.

2. The enclosure of claim 1, wherein one or more exterior wall apertures of the plurality exterior wall apertures is positioned on the second portion.

3. The enclosure of claim 1, further comprising a base on which the floor is positioned, wherein:
- the base comprises a number of channels; and
- each channel of the number of channels connects an exterior wall aperture of the plurality of exterior wall apertures and at least one floor aperture of the floor apertures.

4. The enclosure of claim 3, wherein the second portion comprises a surface of the base.

5. The enclosure of claim 4, wherein the plurality of exterior wall apertures is configured to allow gas to pass from an exterior of the enclosure into at least one of an interior of the enclosure and a channel of the number of channels.

6. The enclosure of claim 1, further comprising a passage between the ceiling and a top side of the enclosure.

7. The enclosure of claim 6, wherein each ceiling aperture of the ceiling apertures are configured to allow gas pulled by a gas flow element connected to the passage to travel from an interior of the enclosure, through at least one ceiling aperture of the ceiling apertures, and through the passage.

8. The enclosure of claim 1, wherein the length of an exterior wall of the plurality of exterior walls is not less than four feet and not greater than twenty feet.

9. The enclosure of claim 1, wherein an area of at least one exterior wall aperture of the plurality of exterior wall apertures is not less than 0.01 square inches and not greater than 0.1 square inches.

10. The enclosure of claim 1, wherein each of the floor apertures comprises at least one point that is coplanar, in a plane substantially perpendicular to the floor, with a point of at least one ceiling aperture of the ceiling apertures.

11. The enclosure of claim 1, wherein the plurality of exterior wall apertures comprises at least three apertures extending through a thickness of the same exterior wall of the plurality of exterior walls.

12. The enclosure of claim 3, wherein:

the number of channels comprises a plurality of channels; and each channel of the plurality of channels is connected to an exterior wall aperture of the plurality of exterior wall apertures.

13. A gas ventilation system, comprising:

an enclosure, comprising:

a floor, comprising:

a first surface;

a second surface opposite the first surface; and floor apertures, wherein each one of the floor apertures extends through a thickness of the floor from the first surface to the second surface;

a ceiling comprising ceiling apertures;

interior walls extending, along a length of the interior walls, from the ceiling to at least the floor; and a plurality of exterior walls, each exterior wall of the plurality of exterior walls comprising:

a first portion extending from at least the ceiling of the enclosure to at least the first surface; and a second portion extending below the first surface; and a plurality of exterior wall apertures extending through a thickness of the exterior wall and located no more than a distance, from at least one of the first surface and the second surface of the floor, equal to twenty percent of a total length of the exterior wall; and a passage connected to the ceiling apertures;

a duct connected to the passage; and a gas flow element configured to pull gas from an interior of the enclosure, through the ceiling apertures, through the passage, and into the duct.

14. The gas ventilation system of claim 13, wherein one or more exterior wall apertures of the plurality of exterior wall apertures is positioned on the second portion.

15. The gas ventilation system of claim 14, further comprising a base on which the floor is positioned, wherein:

the base comprises a number of channels; and each channel of the number of channels connects an exterior wall aperture of the plurality of exterior wall apertures and at least one floor aperture of the floor apertures.

16. The gas ventilation system of claim 15, wherein the second portion comprises a surface of the base.

17. The gas ventilation system of claim 15, wherein at least one exterior wall aperture of the plurality of exterior wall apertures is configured to allow gas to pass from an exterior of the enclosure to at least one of an interior of the enclosure and a channel of the number of channels.

18. The gas ventilation system of claim 13, wherein the duct is connected to a vent of at least one of a wall of a structure defining an indoor environment and a ceiling of a structure defining the indoor environment.

19. The gas ventilation system of claim 13, wherein each of the floor apertures comprises at least one point that is coplanar, in a plane substantially perpendicular to the floor, with at least one point of at least one ceiling aperture of the ceiling apertures.

20. A method of manufacturing a gas ventilation system, comprising:

forming an enclosure by:

removably positioning a floor and a base joined to the floor, the floor comprising floor apertures, a first surface, and a second surface opposite the first surface;

joining the floor to interior walls extending, along a length of the interior walls, from a ceiling to at least the floor, wherein joining the floor to the interior walls forms a plurality of exterior walls, each exterior wall of the plurality of exterior walls comprising:

a first portion;

a second portion extending below the first surface; and a plurality of exterior wall apertures extending through a thickness of the exterior wall and located no more than a distance, from at least one of a first surface and a second surface of the floor, equal to twenty percent of a total length of the exterior wall;

joining a ceiling to at least one of the interior walls and an exterior wall of the plurality of exterior walls, the ceiling comprising ceiling apertures; and forming a passage connected to the ceiling apertures;

connecting a duct to the passage; and positioning a gas flow element exterior to the enclosure, wherein the gas flow element is configured to pull gas from an interior of the enclosure, through the ceiling apertures, through the passage, and into the duct.

* * * * *